United States Patent [19]

Gemein et al.

[11] 4,050,845

[45] Sept. 27, 1977

[54] DEVICE FOR STABILIZING THE POSITION OF ROTORS OF LARGE STEAM TURBINES

[75] Inventors: Rudolf Gemein, Duisburg; Franz Wotschofsky, Mulheim, both of Germany

[73] Assignee: Kraftwerk Union Aktiengesellschaft, Mulheim, Germany

[21] Appl. No.: 725,526

[22] Filed: Sept. 22, 1976

[30] Foreign Application Priority Data

Sept. 30, 1975 Germany ..... 2543689

[51] Int. Cl.[2] ..... F01D 5/20; F04D 29/66

[52] U.S. Cl. ..... 415/172 A; 415/107; 415/119; 415/219 R; 308/9

[58] Field of Search ..... 415/90, 104, 106, 107, 415/172 R, 172 A, 219 C, 219 R, 119, 213 C; 308/9

[56] References Cited

U.S. PATENT DOCUMENTS

| | | | |
|---|---|---|---|
| 930,907 | 8/1909 | Westinghouse | 415/172 A |
| 941,395 | 11/1909 | Westinghouse | 415/172 A |
| 1,999,711 | 4/1935 | Zetterquist | 415/172 A |
| 2,045,918 | 6/1936 | Moody | 415/172 A |
| 3,037,457 | 6/1962 | Sternlicht | 415/90 |
| 3,110,527 | 11/1963 | Fox | 415/90 |
| 3,290,004 | 12/1966 | Ishibashi | 415/119 |

FOREIGN PATENT DOCUMENTS

| | | | |
|---|---|---|---|
| 1,193,436 | 11/1959 | France | 308/9 |
| 313,128 | 6/1917 | Germany | 415/172 A |
| 314,067 | 4/1932 | Italy | 415/172 A |
| 134,451 | 1/1928 | Switzerland | 415/172 A |
| 767,656 | 2/1957 | United Kingdom | 415/172 A |

*Primary Examiner*—C. J. Husar
*Attorney, Agent, or Firm*—Herbert L. Lerner

[57] ABSTRACT

A steam turbine having a rotor and a stator, the rotor having rotor blade rings at the outer periphery thereof and the stator having a carrier for vanes interposed between the rotor blade rings respectively in axial direction of the rotor, the rotor blade rings having respective shroud bands at the radially outer periphery thereof, the shroud bands and the stator carrier defining gaps therebetween, a device for stabilizing the position of the rotor includes means for enlarging at least a part of the radial gaps, respectively, the means having channels of substantially circular cross section each extending in the form of a crescent in peripheral direction of the turbine over at least an upper half of the turbine.

8 Claims, 4 Drawing Figures

DEVICE FOR STABILIZING THE POSITION OF ROTORS OF LARGE STEAM TURBINES

The invention relates to a device for stabilizing the position of rotors of large steam turbines to ensure quiet running without damage to the bearings.

In steam turbines of relatively older types of construction, where in the weight of the rotor was very large in comparison with the steam mass flow or to the steam throughput weight, the high weight of the rotor resulted in quiet running, since the steam forces had only a secondary effect upon the rotor. In modern steam turbines of relatively high power rating with relatively light-weight rotors but great mass flows, the steam forces can exert, in contrast thereto, a great influence upon the running behavior and cause dangerous low-frequency instabilities of the running gear. Thermal effects and uncontrollable eccentric central displacements between the housing and the rotor caused thereby can produce one-sided changes of the radial gap between the rotor blade rings and the guide vane carrier, which generated forces that either lit the rotor up or press it firmly into its bearings and thus has a negative or positive effect upon the running behavior of the turbine.

It is therefore an object of the invention to provide means for generating and utilizing these additional forces intentionally in such a manner that an additional force acting upon the rotor is produced thereby, which presses the rotor firmly into the bearings thereof and thus leads to quiet running.

With the foregoing and other objects in view, there is provided, in accordance with the invention in a steam turbine having a rotor and a stator, the rotor having rotor blade rings at the outer periphery thereof and the stator having a carrier for vanes interposed between the rotor blade rings respectively in axial direction of the rotor, the rotor blade rings having respective shroud bands at the radially outer periphery thereof, the shroud bands and the stator carrier defining gaps therebetween, a device for stabilizing the position of the rotor comprising means for enlarging at least a part of the radial gaps, respectively, the means comprising channels of substantially circular cross section each extending in the form of a crescent in peripheral direction of the turbine over at least an upper half of the turbine.

Through this intentional enlargement or widening of the gap, the steam flowing through the gap is whirled about or rendered turbulent in the channel and the velocity component thereof is transformed into a pressure component, so that a differential pressure head between the upper side and the lower side of the rotor is produced. The major part of the steam in the gap flows in peripheral or circumferential direction toward the lower pressure, the differential pressure producing a force directed toward the rotor and pressing the rotor downardly and, therefore, into the bearings thereof.

In accordance with another feature of the invention, the channels are formed or incised in the stator vane carrier.

In accordance with a further feature of the invention, and to increase the turbulence of the steam flow, the shroud bands of the rotor blade rings are formed at the outer periphery thereof with respective trough-like recesses extending along the entire outer periphery thereof.

In accordance with an added feature of the invention, sealing bands are disposed in the gaps for constricting the flow cross section thereof, the flow cross section or the height of the gaps at the sealing bands being constant.

In accordance with an additional feature of the invention, the sealing bands are received in recesses formed or incised in the stator vane carrier at each side of the channels.

In accordance with yet another feature of the invention, the stator vane carrier has an inner peripheral surface and the channels are formed in the inner peripheral surface, the stator vane carrier having a given axis, the channels extending over the entire inner peripheral surface of the stator vane carrier and having an outer circumference with a center that is located eccentric to the given axis of the stator vane carrier.

In accordance with yet a further feature of the invention, the center of the outer circumference of the channels is located radially above the given axis of the stator vane carrier.

In accordance with a concomitant feature of the invention, the shroud bands of the rotor blade rings are formed at the outer periphery thereof with respective trough-like recesses extending along the entire outer periphery thereof, the shroud bands having respective webs located downstream of the respective channels that are higher than respective webs thereof located upstream of the respective channels in flow direction of the steam through the gaps, so that the gaps at the steam inlets thereto and outlets therefrom are of equal height.

Although the invention is illustrated and described herein as device for stabilizing the position of rotors of large steam turbines, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings, in which.

Figure 1:
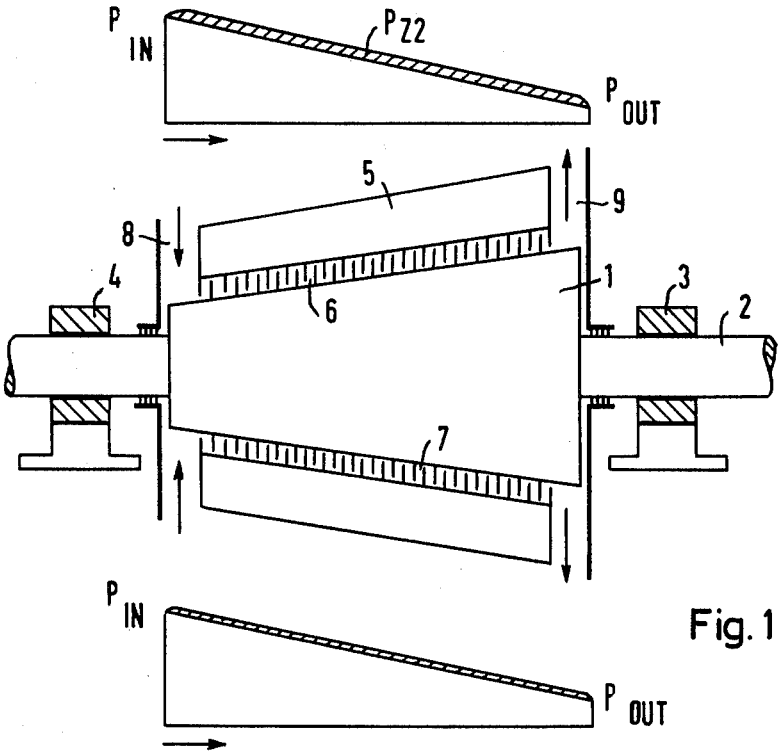
FIG. 1 is a basic diagrammatic view of a conventional turbine with corresponding pressure diagrams for the upper and lower sides of the rotor thereof.

Referring now to the drawing and first, particularly, to FIG. 1 thereof, there is shown a turbine having a bladed rotor 1 provided with a rotor shaft 2 that is supported in bearings 3 and 4. A stator guide-vane carrier 5 and the rotor per se define a flow channel therebetween which, for the purpose of elucidating the invention, is designated herein as an upper flow channel 6 and a lower flow channel 7, although they actually constitute one continuous, annular channel. Steam flows into the turbine 1 through inlets 8 at a pressure $P_{in}$ and discharges therefrom through outlets 9 at a pressure $P_{out.}$ In FIG. 2, the bearing forces that are applied, will first be explained. Due to the shaft 2, a force $P_G$, in the form of the weight of the shaft 2 or rotor 1, acts upon the bearing 3. Upon rotation of the shaft 2, a force $P_O$ is generated by an oil wedge 10 disposed in a gap 11 formed between the shaft 2 and the bearing 3, so that a resultant bearing force $P_R$ is obtained. It is generally well-known that in order for a turbine rotor to attain stable running, the bearing should have a Sommerfeld number which is as high as possible. Since this Sommerfeld number depends substantially upon the specific load of the support surface in the bearing, the forces $P_G$ and $P_R$, respectively, must therefore be as large as possible. Since modern rotors have a relatively small weight, however, as mentioned hereinbefore, and, moreover, the steam forces in the turbine exert great influence upon the position of the rotor, these steam forces are directed and utilized, in accordance with the invention, in such a manner that an additional force $P_{Z1}$ or $P_{Z2}$, respectively, is produced thereby; this is achieved in accordance with the invention, by enlarging the flow channel 6 or the gap above the rotor in relation to the flow channel 7.

Figure 2:
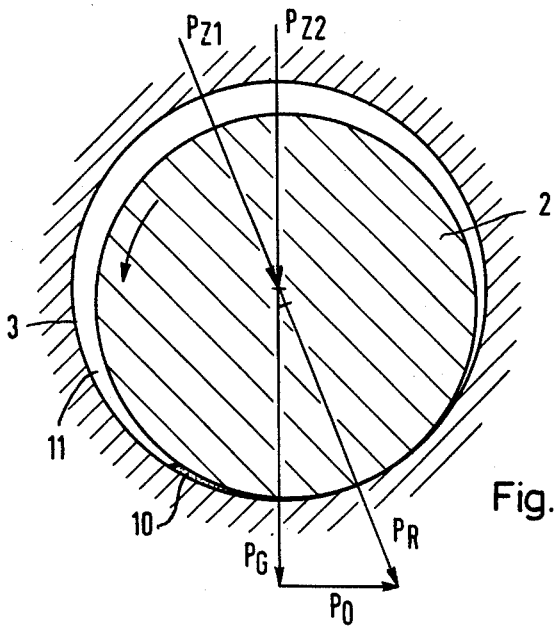
FIG. 2 is a vector diagram for the forces appearing in a bearing of the turbine of FIG. 1, for example.
Figure 3:
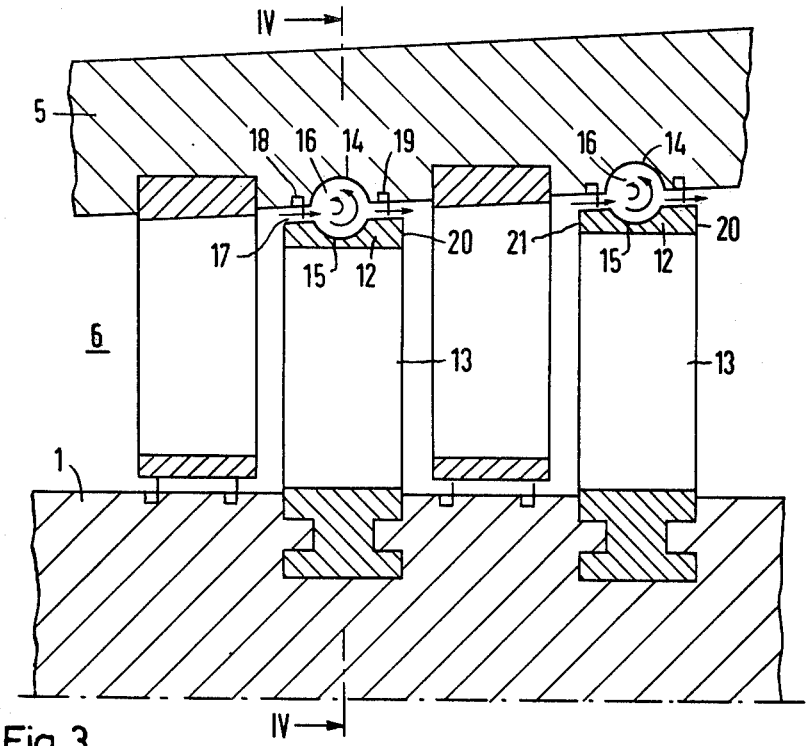
FIG. 3 is a longitudinal cross-sectional view of a bladed flow channel section in a turbine according to the invention.
Figure 4:
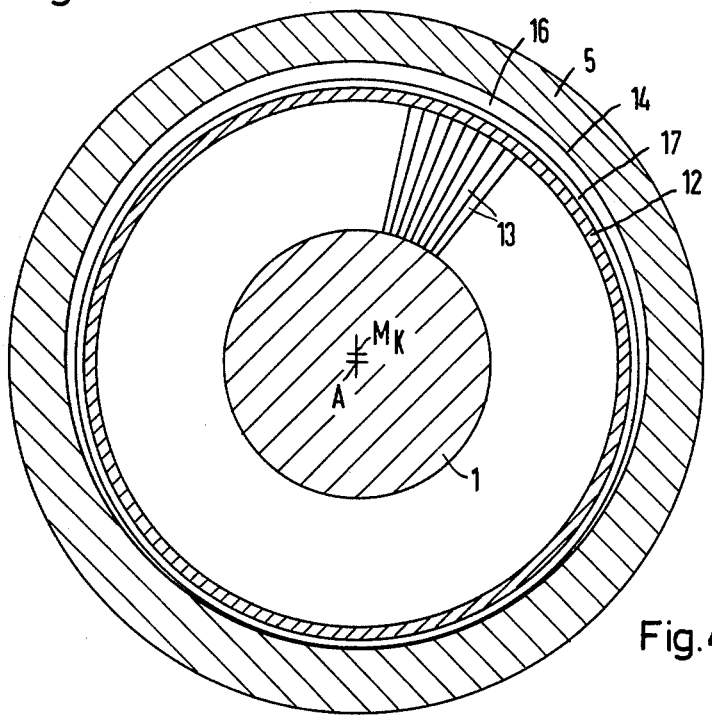
FIG. 4 is a cross-sectional view of FIG. 3 taken along the line IV—IV is the direction of the arrows.

As is apparent from FIG. 3, channels 14 are incised into the guide-vane carrier 5 of the stator opposite the shroud bands 12 of the rotor balde rings 13, to achieve the hereinaforementioned goal in accordance with the invention; as can be seen in the cross-sectional view of FIG. 4, these channels 14 narrow down in the shape of a crescent toward both sides over the periphery of the guide vane carrier 5. Advantageously, the shroud bands 12 are formed with a trough-like recess or cutout 15 extending over the entire periphery thereof opposite the channels 14, so that overall, the sealing gap 17 is provided with an enlargement or widening 16 having a substantially circular cross section. The steam which then flows in through the gap 17, that may be constricted additionally be sealing bands or strips 18 and 19, is whirled about or rendered turbulent in the channel 16, the velocity component of the steam being transformed into a pressure component in the form of a differential dynamic pressure or pressure head. This differential pressure head is proportional to the cross section of the channel 16. Since this channel 16 is of maximal cross section in the upper portion of the turbin i.e. in the flow channel 6 according to FIG. 1, an additional force corresponding to the vector $P_{Z2}$, as shown in FIG. 2 is produced on the rotor 1. It therefore follows from the pressure diagrams located above and below the view of the turbine in FIG. 1, that, due to the larger gap width above the rotor, a higher pressure also prevails in the upper channel 6 than in the lower channel 7, the difference in the shaded area in the pressure diagrams indicating the respective additional pressure corresponding to the vector $P_{Z2}$ resulting from the enlargement or widening of the gap 17. The crescent-shaped channels 16 may extend over the entire periphery of the turbine or only over the upper half thereof as viewed in FIGS. 3 and 4. As is seen in FIG. 4, to produce or machine these channels 16, the center $M_K$ of the outer periphery of the channels 16 may be located eccentrically to the axis A of the stator guidevane carrier 5, so that then the channel shape shown in FIG. 4 is obtained with the maximal cross section thereof radially above in the turbine and limited radially below virtually to the size of the trough-like recess or cutout 15 formed in the shroud bands 12 of the rotor blade rings 13.

To improve the flow conditions and for optimal utilization of the desired pressure increase, it is furthermore advantageous if the downstream web 20 of the shroud covers 12 has a greater height or thickness than the upstream web 21 thereof, as viewed in flow direction of the steam as represented by the associated arrows in FIG. 3, so that the gaps 17 in front of and behind i.e. upstream and downstream, respectively, of the channels 16 have the same height.

Through this controlled or intentional widening of the sealing gaps in the upper half of the turbine, the steam forces acting upon the rotor are intentionally directed so that they force or press the rotor additionally into the bearings and thereby prevent the bearing journals or pins from traveling upwardly in the bearing, so that stable and quite running is ensured. In addition, also in the event of a downward deflection or bending of the housing due to thermal effects and a consequent widening or enlargement of the lower gap, the rotor is reliably prevented from becoming raised since the higher gap pressure that is produced can flow off upwardly toward the channels or can equalize or balance out in that direction. Additional lifting or buoyancy forces are also thereby avoided.

There are claimed:

1. In a steam turbine having a rotor and a stator, the rotor having rotor blade rings at the outer periphery thereof and the stator having a carrier for vanes interposed between the rotor blade rings respectively in axial direction of the rotor, the rotor blade rings having respective shroud bands at the radially outer periphery thereof, the shroud bands and the stator carrier defining gaps therebetween, a device for stabilizing the position of the rotor comprising means for enlarging at least a part of the radial gaps, respectively, said means comprising channels of substantially circular cross section each extending in the form of a crescent in peripheral direction of the turbine over at least an upper half of the turbine.

2. Device according to claim 1 wherein said channels are formed in the stator vane carrier.

3. Device according to claim 1 wherein the shroud bands of the rotor blade rings are formed at the outer periphery thereof with respective trough-like recesses extending along the entire outer periphery thereof.

4. Device according to claim 1 including sealing bands disposed in the gaps for constricting the flow cross section thereof, said flow cross section being constant in the gaps at said sealing bands.

5. Device according to claim 4 wherein said sealing bands are received in recesses formed in the stator vane carrier at each side of said channels.

6. Device according to claim 1 wherein the stator vane carrier has an inner peripheral surface and said channels are formed in said inner peripheral surface, said stator vane carrier having a given axis, said channels extending over the entire inner peripheral surface of said stator vane carrier and having an outer circumference with a center that is located eccentric to said given axis of said stator vane carrier.

7. Device according to claim 6 wherein said center of said outer circumference of said channels is located radially above said given axis of said stator vane carrier.

8. Device according to claim 1 wherein the shroud bands of the rotor blade rings are formed at the outer periphery thereof with respective trough-like recesses extending along the entire outer periphery thereof, said shroud hands having respective webs located downstream of the respective channels that are higher than respective webs thereof located upstream of the respective channels in flow direction of the steam through said gaps, so that said gaps at the steam inlets thereto and outlets therefrom are of equal height.

* * * * *